US006135621A

United States Patent [19]

Bach et al.

[11] Patent Number: 6,135,621

[45] Date of Patent: Oct. 24, 2000

[54] ILLUMINATED HANDLE

[76] Inventors: Kent Bach, 110 E. George St., Apt. 219, Bensenville, Ill. 60106; Tom Jonke, 304 S. Adams, Westmont, Ill. 60539

[21] Appl. No.: 09/023,910

[22] Filed: Feb. 13, 1998

[51] Int. Cl.[7] ..... F21V 21/08

[52] U.S. Cl. ..... 362/399; 362/245; 16/110.1; 16/436; 16/903; 74/543

[58] Field of Search ..... 16/111 R, 110.1, 16/436, 903; 74/543–545; 256/59, 65; 362/102, 145, 146, 151, 152, 241, 245, 184, 186, 399, 400, 474, 551, 576, 577

[56] References Cited

U.S. PATENT DOCUMENTS

| | | | |
|---|---|---|---|
| 1,203,576 | 11/1916 | Broadhead | 362/184 |
| 2,242,981 | 5/1941 | Pedersen | 362/577 |
| 2,479,500 | 8/1949 | Longberg | 362/146 |
| 4,231,077 | 10/1980 | Joyce et al. | 362/577 |
| 4,274,131 | 6/1981 | Praamsma | 362/355 |
| 5,339,228 | 8/1994 | Baethge et al. | 362/146 |
| 5,396,740 | 3/1995 | Bocchi | 256/65 |
| 5,692,822 | 12/1997 | Dreyer | 362/245 |
| 5,957,566 | 9/1999 | Chiu | 362/186 |

FOREIGN PATENT DOCUMENTS

| | | | |
|---|---|---|---|
| 406094922 | 4/1994 | Japan | 362/576 |

*Primary Examiner*—Alan Cariaso

[57] ABSTRACT

An illuminated handle comprising a tubular bar having a first end and a second end, a first lens located at the first end of the bar, a first light source located at the first end of the bar, a first curved mirror partially surrounding the first light source and enclosing the first end of the bar, a polished surface located at the second end of the bar, and a second curved mirror enclosing the second end of the bar.

23 Claims, 2 Drawing Sheets

ILLUMINATED HANDLE

TECHNICAL FIELD OF THE INVENTION

The present invention relates to an illuminated handle. More specifically, to a lighted bar for use in any interior/exterior application in which light would be a convenience or safety advantage.

BACKGROUND OF THE INVENTION

Handrails and handles are used in a variety of applications. They are used on boats to assist in entry, and in safe movement about the boat. They are used in motor homes and other vehicles to assist in entry and exit. They are used in stairwells to provide support for those ascending or descending. Rails are used as nightlights, and as towel racks in bathrooms, as well as to assist handicapped persons to move about or perform tasks.

Hospitals and nursing homes use rails for assistance in patient transport and support. Rails and handles are also used on poles, fences, and decorative applications. A need has developed for a handle used in such situations that can be readily seen, even in the dark. The illuminated handle of the present invention solves this and other problems.

SUMMARY OF THE INVENTION

The illuminated handle of the present invention comprises a solid or tubular bar having a first end and a second end, a lens located at the first end of the bar, a light source located at the first end of the bar, a first curved mirror partially surrounding the light source and enclosing the first end of the bar, a polished surface located at the second end of the bar, and a second curved mirror enclosing the second end of the bar.

Alternatively, the handle can comprise a solid or tubular bar having a first end and a second end, a first lens located at the first end of the bar, a first light source located at the first end of the bar, a first curved mirror partially surrounding the first light source and enclosing the first end of the bar, a second lens located at the second end of the bar, a second light source located at the second end of the bar, a second curved mirror partially surrounding the second light source and enclosing the second end of the bar.

The illuminated handle of the present invention results in increased luminosity of the surface of the bar. It also permits many different lighting effects by varying the diffusion, field of visibility, and brightness of the light. The light can be of different colors, and the bar may be clear or translucent or color coated.

Other advantages and aspects of the present invention will become apparent upon reading the following description of the drawings and the detailed description of the invention.

DETAILED DESCRIPTION OF THE PREFERRED EMBODIMENT

Figure 1:
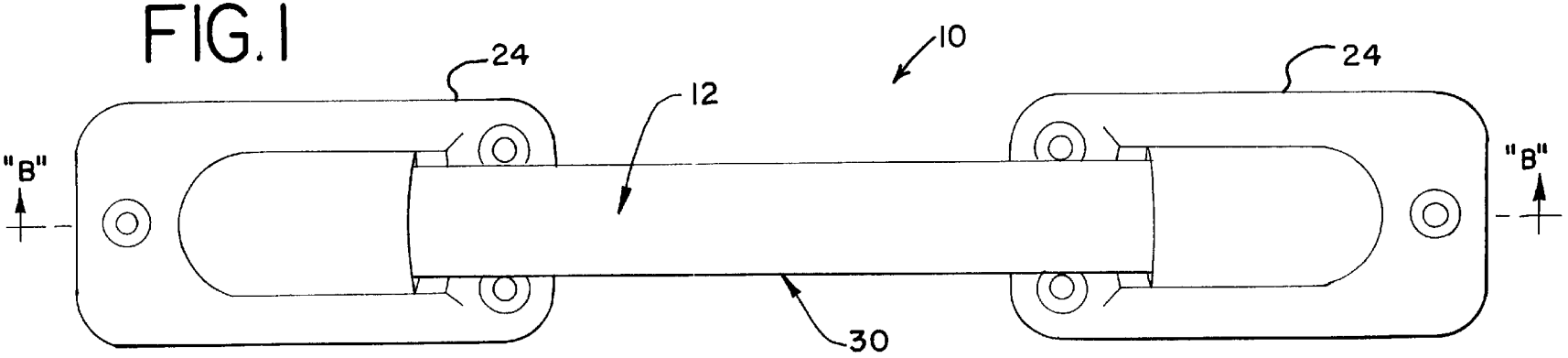
FIG. 1 is a top view of the illuminated handle of the present invention.
Figure 2:
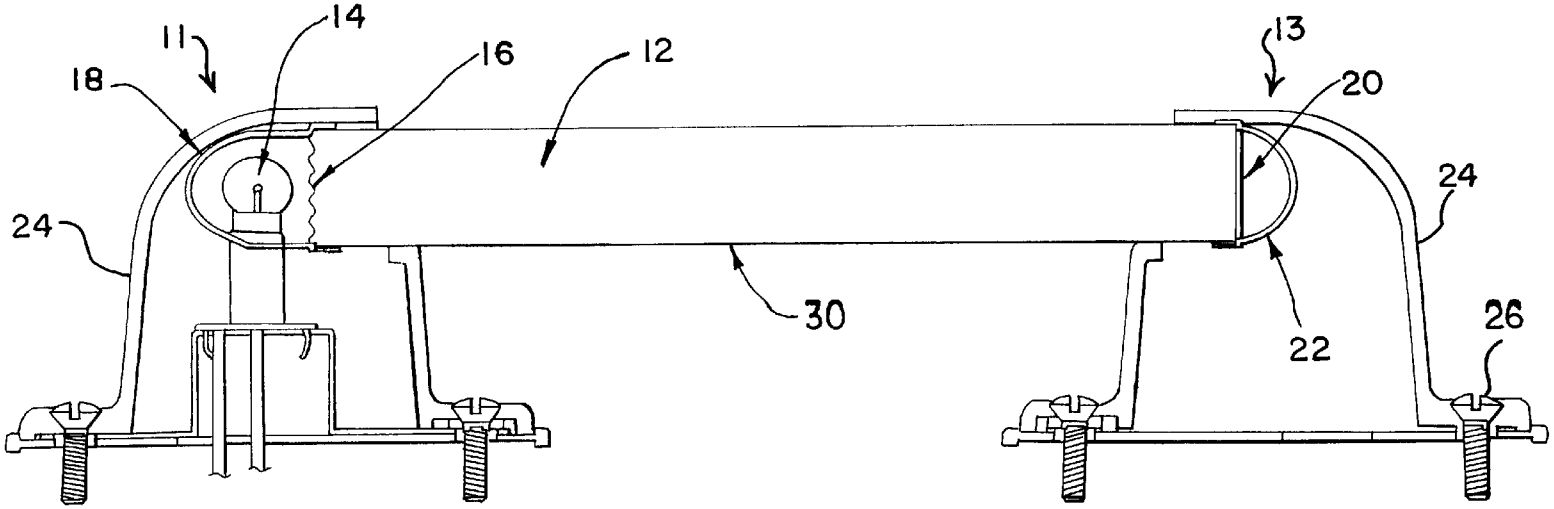
FIG. 2 is a cut-away side view of the illuminated handle of the present invention.
Figure 3:
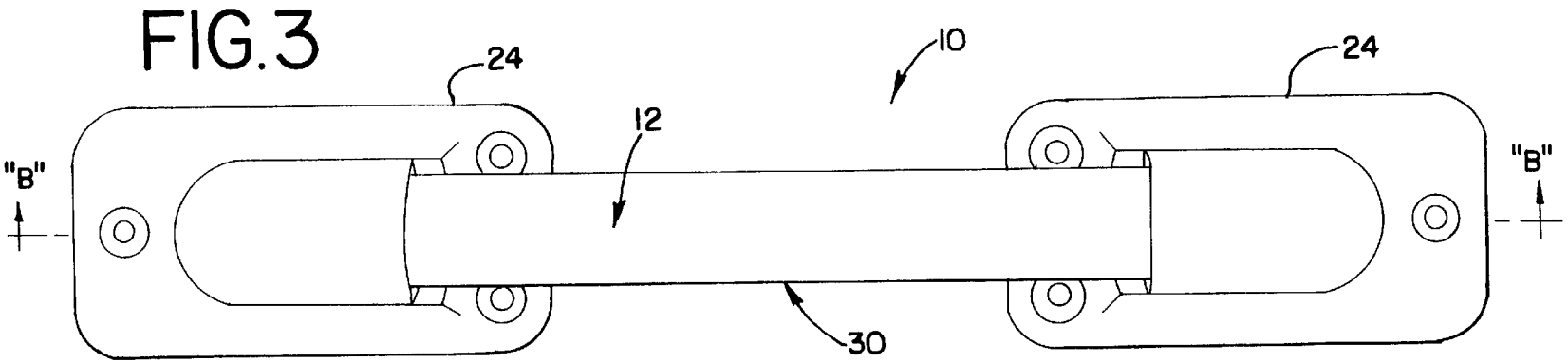
FIG. 3 is a top view of a second embodiment of the illuminated handle of the present invention.
Figure 4:
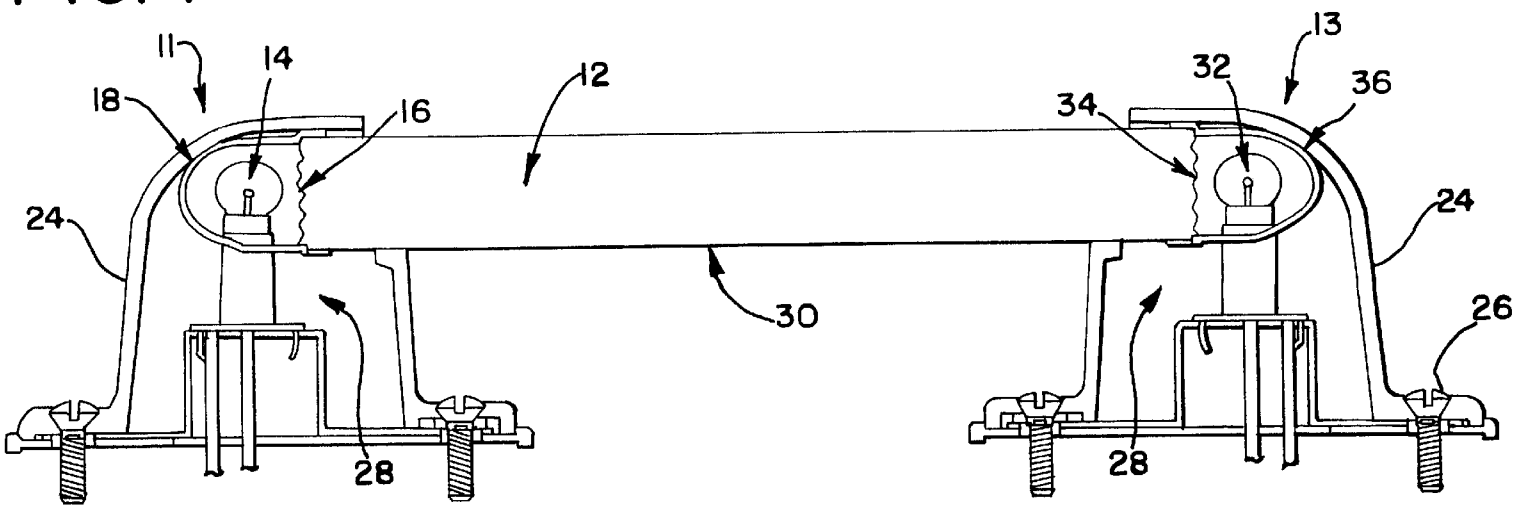
FIG. 4 is a cut-away side view of the second embodiment of the illuminated handle of the present invention.

While the invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

The illuminated handle 10 of the present invention comprises a bar 12. The body of the bar 12 is either a solid or hollow tube made of any suitable material, and may be made of glass or plastic or acrylic. The bar 12 may be either translucent clear or color coated. The bar 12 has first and second ends 11 and 13, and has at its first end 11 a first light source 14. The first light source 14 can be an electric bulb suitable for the luminosity required, and may be of different colors. A first lens 16 is located at the first end 11 of the bar 12, and is perpendicular to the axis of the bar 12. A first curved mirror 18 surrounds the first light source 14. The first curved mirror 18 is of a diameter smaller than that of the bar 12, and attaches to the first end 11 of and encloses the bar 12. The first curved mirror 18 surrounds the first light source 14.

At the second end 13 of the bar 12 is a polished surface 20. The surface 20 is perpendicular to the axis of the bar 12. A second curved mirror 22 fits over the second end 13 of the bar 12 also enclosing the surface 20. The second curved mirror 22 has a curvature tangent to the polished surface 20.

The body of bar 12 may have within it metalescent flakes or glass dust embedded therein. The surface may also be frosted, or made different colors. This would vary the diffusion and/or visibility of the light to meet the application in which the invention is used.

Each end 11 and 13 of the bar 12 encased in a housing 24. The housings 24 also encapsulate the first light source 14, first lens 16, first curved mirror 18 at the first end 11 of the bar 12, and the polished surface 20 and second curved mirror 22 at the second end 13 of the bar 12. The housings 24 may be of any shape to fit the application to which the illuminated handle is put. They are also adapted to attach the handle 10 to another surface, such as with screws 26.

In operation, the first light source 14 emits light in all directions. Any light that does not emit in the direction of the first lens 16 will be reflected back toward the first lens 16 by the first curved mirror 18. Because the first curved mirror 18 is of a diameter smaller than that of the bar 12, it decreases the loss of light in the corners 28 of the bar 12.

When light enters the bar 12, the first lens 16 refracts light in different directions. Light is then incident on a surface 30 of the bar 12 in several locations along its length and spanning the entire circumference of the bar 12. Some of the light is refracted out of the bar 12 through the surface 30. Light reflected internally travels through the bar 12.

Any light reaching the second end 13 of the bar 12 opposite the first light source 14 is refracted out of the bar 12 by the polished surface 20. Light going through the polished surface 20 is reflected back into the bar 12 by the second curved mirror 22. Reentering light is refracted into the bar 12.

Alternatively, the bar 12 may have a second light source 32 at its second end 13. The second light source 32 can be, but need not be, identical to the first light source 14. In this embodiment, a second lens 34 is located at the second end 13 of the bar 12, and is perpendicular to the axis of the bar 12. A second curved mirror 36 surrounds the second light source 32. The second curved mirror 36 is of a diameter smaller than that of the bar 12, and attaches to the second end 13 of and encloses the bar 12. The second curved mirror 36 surrounds the second light source 32.

In operation of the second embodiment, the first light source 14 emits light in all directions. Any light that does not emit in the direction of the first lens 16 will be reflected back toward the first lens 16 by the first curved mirror 18. Because the first curved mirror 18 is of a diameter smaller than that of the bar 12, it decreases the loss of light in the corners 28 of the bar 12.

When light enters the bar 12, the first lens 16 refracts light in different directions. Light is then incident on a surface 30 of the bar 12 in several locations along its length and spanning the entire circumference of the bar 12. Some of the light is refracted out of the bar 12 through the surface 30. Light reflected internally travels through the bar 12.

Similarly, at the second end 13 of the bar 12, the second light source 32 emits light in all directions. Any light that does not emit in the direction of the second lens 34 will be reflected back toward the second lens 34 by the second curved mirror 36. Because the second curved mirror 36 is of a diameter smaller than that of the bar 12, it decreases the loss of light in the corners 28 of the bar 12.

When light enters the bar 12, the second lens 34 refracts light in different directions. Light is then incident on a surface 30 of the bar 12 in several locations along its length and spanning the entire circumference of the bar 12. Some of the light is refracted out of the bar 12 through the surface 30. Light reflected internally travels through the bar 12.

While specific embodiments have been illustrated and described, numerous modifications are possible without departing from the spirit of the invention, and the scope of protection is only limited by the scope of the accompanying claims.

We claim:

1. An illuminated handle comprising:

a bar having a first end and a second end;

a first divergent lens located at the first end of the bar;

a first light source located at the first end of the bar;

a first curved mirror partially surrounding the first light source and enclosing the first end of the bar;

a polished surface located at the second end of the bar; and a second curved mirror enclosing the second end of the bar.

2. The illuminated handle of claim 1 wherein the bar is made of acrylic.

3. The illuminated handle of claim 1 wherein the bar is color coated.

4. The illuminated handle of claim 1 wherein the bar contains metalescent flakes.

5. The illuminated handle of claim 1 wherein the bar contains glass dust.

6. The illuminated handle of claim 1 further comprising a first housing containing the lens, light source, and curved mirror, located at the first end of the tubular bar, and a second housing containing the polished surface and curved mirror, located at the second end of the bar.

7. The illuminated handle of claim 6 wherein the first housing and second housing attach to a surface by screws.

8. The illuminated handle of claim 1 wherein the bar is tubular.

9. The illuminated handle of claim 1 wherein the bar is solid.

10. An illuminated handle comprising:

a bar having a first end and a second end;

a first divergent lens located at the first end of the bar;

a first light source located at the first end of the bar;

a first curved mirror partially surrounding the first light source and enclosing the first end of the bar;

a second divergent lens located at the second end of the bar;

a second light source located at the second end of the bar; and a second curved mirror partially surrounding the second light source and enclosing the second end of the bar.

11. The illuminated handle of claim 10 wherein the bar is made of acrylic.

12. The illuminated handle of claim 10 wherein the bar is color coated.

13. The illuminated handle of claim 10 wherein the bar contains metalescent flakes.

14. The illuminated handle of claim 10 wherein the bar contains glass dust.

15. The illuminated handle of claim 10 further comprising a first housing containing the lens, light source, and curved mirror, located at the first end of the tubular bar, and a second housing containing the polished surface and curved, located at the second end of the tubular bar.

16. The illuminated handle of claim 15 wherein the first housing and second housing attach to a surface by screws.

17. The illuminated handle of claim 10 wherein the bar is tubular.

18. The illuminated handle of claim 10 wherein the bar is solid.

19. An illuminated handle comprising:

a translucent bar having a first end and a second end;

a first divergent lens located at the first end of the bar;

a first light source located at the first end of the bar; and a polished surface located at the second end of the bar.

20. An illuminated handle comprising:

a bar having a first end and a second end;

a first divergent lens located at the first end of the bar;

a first light source located at the first end of the bar;

a polished surface located at the second end of the bar; and a first curved mirror partially surrounding the first light source and enclosing the first end of the bar.

21. An illuminated handle comprising:

a bar having a first end and a second end;

a first divergent lens located at the first end of the bar;

a first light source located at the first end of the bar;

a polished surface located at the second end of the bar; and a second curved mirror enclosing the second end of the bar.

22. The illuminated handle of claim 1 wherein the bar is frosted.

23. The illuminated handle of claim 10 wherein the bar is frosted.

* * * * *